US008563496B2

(12) United States Patent
Cermenati et al.

(10) Patent No.: US 8,563,496 B2
(45) Date of Patent: Oct. 22, 2013

(54) LIQUID ACIDIC HARD SURFACE CLEANING COMPOSITION

(75) Inventors: Laura Cermenati, Brussels (BE); William Mario Laurent Verstraeten, Herent (BE); Lucie Marie Cretieneau, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 412 days.

(21) Appl. No.: 12/964,844

(22) Filed: Dec. 10, 2010

(65) Prior Publication Data

US 2011/0146707 A1 Jun. 23, 2011

(30) Foreign Application Priority Data

Dec. 17, 2009 (EP) ..... 09179649

(51) Int. Cl.
*C11D 7/08* (2006.01)
*C11D 3/20* (2006.01)
*C11D 3/08* (2006.01)

(52) U.S. Cl.
CPC ..... *C11D 3/2075* (2013.01)
USPC ..... 510/238; 510/253; 510/477; 134/2

(58) Field of Classification Search
USPC ..... 510/238, 253, 477; 134/2
See application file for complete search history.

(56) References Cited

U.S. PATENT DOCUMENTS

| | | | | |
|---|---|---|---|---|
| 2,082,275 | A | 6/1937 | Daimler et al. | |
| 2,255,082 | A | 9/1941 | Orthner et al. | |
| 2,438,091 | A | 3/1948 | Lynch et al. | |
| 2,528,378 | A | 10/1950 | Mannheimer | |
| 2,658,072 | A | 11/1953 | Kosmin et al. | |
| 2,702,279 | A | 2/1955 | Funderburk et al. | |
| 3,586,715 | A | 6/1971 | Smeets | |
| 3,812,044 | A | 5/1974 | Connor et al. | |
| 3,929,678 | A | 12/1975 | Laughlin et al. | |
| 4,199,469 | A | 4/1980 | Walzer | |
| 4,228,044 | A | 10/1980 | Cambre | |
| 4,704,233 | A | 11/1987 | Hartman et al. | |
| 5,695,573 | A | 12/1997 | Becker | |
| 6,569,261 | B1 | 5/2003 | Aubay et al. | |
| 6,593,288 | B2 | 7/2003 | Aubay et al. | |
| 6,849,586 | B2 * | 2/2005 | Avery et al. | 510/191 |
| 7,186,676 | B2 * | 3/2007 | Boone et al. | 510/418 |
| 7,196,046 | B2 * | 3/2007 | Cheung et al. | 510/418 |
| 7,256,167 | B2 * | 8/2007 | Cheung et al. | 510/418 |
| 7,264,845 | B2 | 9/2007 | Papadaki et al. | |
| 7,745,384 | B2 * | 6/2010 | Perry et al. | 510/253 |
| 7,923,428 | B2 * | 4/2011 | Geffroy et al. | 510/492 |
| 8,093,194 | B2 * | 1/2012 | Chapman et al. | 510/191 |
| 8,163,100 | B2 * | 4/2012 | Karagianni et al. | 134/25.2 |
| 8,193,138 | B2 * | 6/2012 | Nekmard | 510/218 |
| 2004/0186037 | A1 * | 9/2004 | Cheung et al. | 510/426 |
| 2005/0170982 | A1 * | 8/2005 | Boone et al. | 510/238 |
| 2005/0176613 | A1 * | 8/2005 | Wai Cheung et al. | 510/383 |
| 2009/0197786 | A1 * | 8/2009 | Perry et al. | 510/191 |
| 2010/0144581 | A1 * | 6/2010 | Nekmard | 510/405 |
| 2011/0028369 | A1 * | 2/2011 | Chapman et al. | 510/191 |

FOREIGN PATENT DOCUMENTS

| | | | |
|---|---|---|---|
| DE | 10 2009 001559 | A1 | 12/2009 |
| EP | 0 256 696 | A1 | 2/1988 |
| EP | 0 262 897 | A2 | 4/1988 |
| EP | 0 666 305 | A1 | 8/1995 |
| EP | 0 666 306 | A1 | 8/1995 |
| EP | 0 957 156 | A1 | 11/1999 |
| EP | 1 111 038 | A1 | 6/2001 |
| EP | 2 025 743 | B1 | 4/2011 |
| WO | WO 03/070872 | A1 | 8/2003 |
| WO | WO 2004/018599 | A1 | 3/2004 |
| WO | WO 2005/113735 | A1 | 12/2005 |
| WO | WO 2009/024743 | A1 | 2/2009 |

OTHER PUBLICATIONS

International Search Report, International Application No. PCT/US2010/060245, mailed Feb. 11, 2011, 11 pages.

* cited by examiner

*Primary Examiner* — Gregory Webb
(74) *Attorney, Agent, or Firm* — John T. Dipre; Amy I. Ahn-Roll

(57) ABSTRACT

The present invention relates to a liquid acidic hard surface cleaning composition having a pH of above 2.0 and comprising formic acid, citric acid and an alkaline material.

15 Claims, No Drawings

LIQUID ACIDIC HARD SURFACE CLEANING COMPOSITION

FIELD OF THE INVENTION

The present invention relates to liquid compositions for cleaning a variety of hard surfaces such as hard surfaces found in around the house, such as bathrooms, toilets, garages, driveways, basements, gardens, kitchens, etc. More specifically, the compositions of the present invention deliver good limescale removal performance (i.e., removal of pure limescale deposits and/or limescale-containing soils) whilst not being considered corrosive.

BACKGROUND OF THE INVENTION

Liquid compositions for cleaning hard-surfaces have been disclosed in the art. Much of the focus for such compositions has been on providing outstanding cleaning performances on a variety of soils and surfaces and, more particularly, to provide improved performance on the removal of limescale.

Indeed, one type of stains frequently occurring on hard surfaces found in bathrooms, toilets, garages, driveways, basements, gardens, kitchens, etc., are limescale deposits. Limescale deposits, are formed due to the fact that tap water contains a certain amount of solubilised ions, which upon water evaporation eventually deposit as salts such as calcium carbonate on hard surfaces, which are frequently in contact with water. The visible limescale deposits result in an unaesthetic aspect of the surfaces. The limescale formation and deposition phenomenon is even more acute in places where water is particularly hard. Furthermore, limescale deposits are prone to combination with other types of soils, such as soap scum or grease, and can lead to the formation of limescale-soil mixture deposits (limescale-containing soils). The removal of limescale deposits and limescale-containing soils is herein in general referred to as "limescale removal" or "removing limescale".

It is known to use acidic compositions to clean hard surfaces and that such formulations show good overall cleaning performance and good limescale removal performance. Indeed, for example WO 2004/018599 describes acidic hard surface cleaning compositions comprising an acid or a mixture thereof. Amongst the acids suitable in hard surface cleaning compositions, formic acid and citric acid have been identified as suitable acids that provide good limescale removal performance.

However, there are some limitations to the convenience of acidic compositions employed as hard surface cleaner. In particular, it has been found that hard surface cleaner compositions at their un-buffered pH comprising citric acid and formic acid are considered corrosive.

It is thus an objective of the present invention to provide a liquid, acidic hard surface cleaning composition that provides good limescale removal performance whilst not being corrosive. In particular, it is an objective of the present invention to provide a liquid hard surface cleaning composition comprising formic acid and citric acid that provides an acceptable limescale removal performance especially when compared to other compositions having a similar pH as claimed herein comprising formic acid or citric acid on their own or other compositions (having similar levels of free-acidity) having a lower pH as claimed herein and comprising formic acid or citric acid in combination with another acid (such as sulfuric acid) whilst not being corrosive.

It has been found that the above objective can be met by the composition according to the present invention.

It is an advantage of the compositions according to the present invention that they may be used to clean hard surfaces made of a variety of materials like glazed and non-glazed ceramic tiles, enamel, stainless steel, Inox®, Formica®, vinyl, no-wax vinyl, linoleum, melamine, glass, plastics.

BACKGROUND ART

WO 2004/018599 describes acidic hard surface cleaning compositions comprising an acid or a mixture thereof.

EP-A-0 666 306 and EP-A-0 666 305 describe liquid compositions suitable for removing limescale from hard surfaces comprising maleic acid in combination with a second acid.

SUMMARY OF THE INVENTION

The present invention relates to a liquid acidic hard surface cleaning composition having a pH above 2 and comprising formic acid, citric acid and an alkaline material.

The present invention further encompasses a process of cleaning a hard surface or an object, preferably removing limescale from said hard-surface or said object, comprising the steps of: applying a liquid acidic hard surface cleaning composition according to the present invention onto said hard-surface or said object; leaving said composition on said hard-surface or said object to act; optionally wiping said hard-surface or object, and then rinsing said hard-surface or said object.

The present invention further encompasses the use, in a liquid acidic hard surface cleaning composition comprising formic acid, citric acid an alkaline material, at a pH of above 2, to provide limescale removal performance, whilst being non-corrosive

DETAILED DESCRIPTION OF THE INVENTION

The Liquid Acidic Hard Surface Cleaning Composition

The compositions according to the present invention are designed as hard surfaces cleaners.

The compositions according to the present invention are liquid compositions (including gels) as opposed to a solid or a gas.

The liquid acidic hard surface cleaning compositions according to the present invention are preferably aqueous compositions. Therefore, they may comprise from 70% to 99% by weight of the total composition of water, preferably from 75% to 95% and more preferably from 80% to 95%.

The compositions of the present invention are acidic and have a pH of above 2.0, preferably above 2.0 to 3.6, more preferably from 2.1 to 3.6, still more preferably from 2.1 to 2.9, even more preferably 2.1 to 2.4, yet still more preferably 2.2 to 2.4.

Preferably, the pH of the cleaning compositions herein, as is measured at 25° C., is, with increasing preference in the order given, at least 2.01, 2.1, or 2.2. The pH of the cleaning compositions herein, as is measured at 25° C., is, with increasing preference in the order given, at utmost 3.6, 3.5, 3.4, 3.3, 3.2, 3.1, 3.0, 2.9, 2.8, 2.7, 2.6, 2.5, 2.4 or 2.3.

In an alternative embodiment herein, the compositions of the present invention are acidic and have a pH of above 2.0, preferably above 2.0 to 4.0, more preferably from 2.5 to 4.0, still more preferably from 3.0 to 3.9, even more preferably 3.0 to 3.6.

The compositions herein comprise an alkaline material. Indeed, an alkaline material may be present to trim the pH and/or maintain the pH of the compositions according to the present invention. Examples of alkaline material are sodium hydroxide, potassium hydroxide and/or lithium hydroxide, and/or the alkali metal oxides such, as sodium and/or potassium oxide or mixtures thereof and/or monoethanolamine and/or triethanolamine Other suitable bases include ammonia, ammonium carbonate, choline base, etc. Preferably, source of alkalinity is sodium hydroxide or potassium hydroxide, preferably sodium hydroxide.

Typically the amount of alkaline material is of from 0.001% to 20% by weight, preferably from 0.01% to 10% and more preferably from 0.05% to 3% by weight of the composition. Despite the presence of alkaline material, if any, the compositions herein would remain acidic compositions.

In a preferred embodiment according to the present invention the compositions herein have a water-like viscosity. By "water-like viscosity" it is meant herein a viscosity that is close to that of water. Preferably the liquid acidic hard surface cleaning compositions herein have a viscosity of up to 50 cps at 60 rpm, more preferably from 0 cps to 30 cps, yet more preferably from 0 cps to 20 cps and most preferably from 0 cps to 10 cps at 60 rpm[1] and 20° C. when measured with a Brookfield digital viscometer model DV II, with spindle 2.

In another preferred embodiment according to the present invention the compositions herein are thickened compositions. Thus, the liquid acidic hard surface cleaning compositions herein preferably have a viscosity of from 50 cps to 5000 cps at 20 $s^{-1}$, more preferably from 50 cps to 2000 cps, yet more preferably from 50 cps to 1000 cps and most preferably from 50 cps to 500 cps at 20 $s^{-1}$ and 20° C. when measured with a Rheometer, model AR 1000 (Supplied by TA Instruments) with a 4 cm conic spindle in stainless steel, 2° angle (linear increment from 0.1 to 100 $sec^{-1}$ in max. 8 minutes). Preferably, the thickened compositions according to this specific embodiment are shear-thinning compositions. The thickened liquid acidic hard surface cleaning compositions herein preferably comprise a thickener, more preferably a polysaccharide polymer (as described herein below) as thickener, still more preferably a gum-type polysaccharide polymer thickener and most preferably Xanthan gum.

Formic Acid

The compositions according to the present invention comprise formic acid.

Formic acid has been found to provide excellent limescale removal performance.

Formic acid is commercially available from Aldrich.

The compositions of the present invention may comprise from 0.01% to 5%, preferably from 0.5% to 4%, more preferably from 1% to 3%, by weight of the total composition of formic acid.

Citric Acid

The compositions according to the present invention comprise citric acid.

Suitable citric acid is commercially available from Aldrich, ICI or BASF.

The compositions of the present invention may comprise from 0.1 to 12%, preferably from 1% to 10%, more preferably from 1.5% to 8%, most preferably from 1.5% to 5% by weight of the total composition of citric acid.

The Applicant has unexpectedly found that by using a formic acid and citric acid-containing composition having a pH of above 2.0, the acidic composition provides good cleaning performance whilst not being corrosive. Indeed, a similar composition having a pH below 2.0 (i.e., un-buffered or not sufficiently buffered) will be corrosive. Indeed, the combination of acids along with the selected pH provides an optimal combination of limescale removal and non-corrosiveness is achieved.

By "corrosive" it is meant herein that the composition has to be labeled as corrosive by means of appropriate text and/or pictograms under the Directive 1999/45/EC of the European Parliament and of the Council of 31 May 1999 concerning the approximation of the laws, regulations and administrative provisions of the Member States relating to the classification, packaging and labelling of dangerous preparations. By "non-corrosive" or "not being/considered corrosive" or the like it is meant herein that the composition has not to be labeled as corrosive by means of appropriate text and/or pictograms under the above Directive.

Indeed, it has been found that liquid aqueous acidic cleaning compositions comprising formic acid and citric acid and having a pH of above 2.0 (preferably 2.01-3.6), provide a similar or even improved limescale removal performance (i.e., limescale deposits cleaning performance and limescale-containing soil cleaning performance), as compared to the limescale removal performance obtained by a similar composition having a similar pH as claimed herein but comprising formic acid or citric acid on their own or other compositions having a lower pH as claimed herein and comprising formic acid or citric acid in combination with another acid (such as sulfuric acid), at comparable levels of free-acidity.

Furthermore, liquid aqueous acidic cleaning compositions having a pH of above 2.0 and comprising formic acid and citric acid as claimed herein, are not considered corrosive.

The present invention also encompasses the use, in a liquid acidic hard surface cleaning composition, of formic acid, citric acid and an alkaline material, at a pH of above 2.0, to provide limescale removal performance, whilst not being corrosive.

In another preferred embodiment, the present invention is directed to the use as above described, wherein the good limescale removal performance is achieved when said composition is applied onto said hard surface or object, said composition is left on said hard surface or object to act, preferably with or without wiping and/or mechanical agitation action, and then said hard surface or object is rinsed.

In the use according to the present invention, said composition is left on said hard surface or object to act, preferably for an effective amount of time, more preferably for a period comprised between 1 and 10 minutes, most preferably for a period comprised between 2 and 4 minutes.

Optional Ingredients

The compositions according to the present invention may comprise a variety of optional ingredients depending on the technical benefit aimed for and the surface treated.

Suitable optional ingredients for use herein include other acids, preferably acetic acid and/or oxalic acid and/or lactic acid, chelating agents, nonionic surfactants and/or anionic surfactants, vinylpyrrolidone homopolymer or copolymer, polysaccharide polymer, radical scavengers, perfumes, surface-modifying polymers other than vinylpyrrolidone homo- or copolymers and polysaccharide polymers, solvents, other surfactants, builders, buffers, bactericides, hydrotropes, colorants, stabilizers, bleaches, bleach activators, suds controlling agents like fatty acids, enzymes, soil suspenders, brighteners, anti dusting agents, dispersants, pigments, and dyes.

Lactic Acid

As one preferred, but optional ingredient, the compositions herein comprise lactic acid.

It has been found that the presence of lactic acid additionally provides antimicrobial/disinfecting benefits to the compositions according to the present invention.

Lactic acid is commercially available from Aldrich or Purac. The compositions of the present invention may comprise from 0.1 to 1%, preferably from 0.1% to 0.75% by weight of the composition of lactic acid.

Acetic Acid

As one preferred, but optional ingredient, the compositions herein comprise acetic acid.

Suitable acetic acid is commercially available from Aldrich, ICI or BASF.

The compositions of the present invention may comprise from 0.1 to 1%, preferably from 0.1% to 0.75% by weight of the composition of acetic acid.

Oxalic Acid

As one preferred, but optional ingredient, the compositions herein comprise oxalic acid.

Suitable oxalic acid is commercially available from Aldrich or Clariant.

The compositions of the present invention may comprise from 0.1 to 1%, preferably from 0.1% to 0.75% by weight of the composition of oxalic acid.

Chelating Agent

The compositions of the present invention may comprise a chelating agent or mixtures thereof, as a preferred optional ingredient. Chelating agents can be incorporated in the compositions herein in amounts ranging from 0% to 10% by weight of the total composition, preferably 0.01% to 5.0%, more preferably 0.05% to 1%.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities.

Preferred chelating agents to be used herein are diethylene triamine penta methylene phosphonate (DTPMP) and ethane 1-hydroxy diphosphonate (HEDP). In a particularly preferred execution of the present invention, the chelating agent is selected to be ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA), N-hydroxyethylethylenediamine triacetates, nitrilotri-acetates, ethylenediamine tetrapropionates, triethylenetetraamine-hexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

It has been surprisingly found that the addition of a chelating agent, preferably HEDP, in the composition of the present invention provides an unexpected improvement in terms of limescale removal.

Nonionic and/or Anionic Surfactant

The compositions of the present invention may preferably comprise a nonionic surfactant, or a mixture thereof and/or an anionic surfactant or a mixture thereof as preferred optional ingredients. In a highly preferred embodiment, the compositions according to the present invention, comprise mixture of a nonionic surfactant, or a mixture thereof and an anionic surfactant or a mixture thereof. Indeed, it has been surprisingly found that such a mixture contributes to the limescale and greasy soap scum removal performance of the compositions herein.

Nonionic Surfactant

The compositions of the present invention may preferably comprise a nonionic surfactant, or a mixture thereof. This class of surfactants may be desired as it further contributes to cleaning performance of the hard surface cleaning compositions herein. It has been found in particular that nonionic surfactants strongly contribute in achieving highly improved performance on greasy soap scum removal, the benefit is especially observed at a pH above 3.0.

The compositions according to the present invention may comprise up to 15% by weight of the total composition of a nonionic surfactant or a mixture thereof, preferably from 0.1% to 15%, more preferably from 1% to 10%, even more preferably from 1% to 5%, and most preferably from 1% to 3%.

Suitable nonionic surfactants for use herein are alkoxylated alcohol nonionic surfactants, which can be readily made by condensation processes which are well-known in the art. However, a great variety of such alkoxylated alcohols, especially ethoxylated and/or propoxylated alcohols, is conveniently commercially available. Surfactants catalogs are available which list a number of surfactants, including nonionics.

Accordingly, preferred alkoxylated alcohols for use herein are nonionic surfactants according to the formula RO(E)e(P)pH where R is a hydrocarbon chain of from 2 to 24 carbon atoms, E is ethylene oxide and P is propylene oxide, and e and p which represent the average degree of, respectively ethoxylation and propoxylation, are of from 0 to 24 (with the sum of e+p being at least 1). Preferably, the hydrophobic moiety of the nonionic compound can be a primary or secondary, straight or branched alcohol having from 8 to 24 carbon atoms.

Preferred nonionic surfactants for use in the compositions according to the invention are the condensation products of ethylene oxide and/or propylene oxide with alcohols having a straight or branched alkyl chain, having from 6 to 22 carbon atoms, wherein the degree of alkoxylation (ethoxylation and/or propoxylation) is from 1 to 15, preferably from 5 to 12. Such suitable nonionic surfactants are commercially available from Shell, for instance, under the trade name Neodol® or from BASF under the trade name Lutensol®.

Anionic Surfactant

The compositions of the present invention may preferably comprise an anionic surfactant, or a mixture thereof.

The compositions according to the present invention may comprise up to 15% by weight of the total composition of an anionic surfactant or a mixture thereof, preferably from 0.1% to 15%, more preferably from 1% to 10%, even more preferably from 1% to 5%, and most preferably from 1% to 3%.

Anionic surfactants may be included herein as they contribute to the cleaning benefits of the hard-surface cleaning compositions of the present invention. Indeed, the presence of an anionic surfactant contributes to the greasy soap scum cleaning of the compositions herein. More generally, the presence of an anionic surfactant in the liquid acidic compositions according to the present invention allows to lower the surface tension and to improve the wettability of the surfaces being treated with the liquid acidic compositions of the present invention. Furthermore, the anionic surfactant, or a mixture thereof, helps to solubilize the soils in the compositions of the present invention.

Suitable anionic surfactants for use herein are all those commonly known by those skilled in the art. Preferably, the anionic surfactants for use herein include alkyl sulphonates, alkyl aryl sulphonates, or mixtures thereof.

Particularly suitable linear alkyl sulphonates include C8 sulphonate like Witconate® NAS 8 commercially available from Witco.

Other anionic surfactants useful herein include salts (including, for example, sodium, potassium, ammonium, and substituted ammonium salts such as mono-, di- and triethanolamine salts) of soap, alkyl sulphates, alkyl aryl sulphates alkyl alkoxylated sulphates, C8-C24 olefinsulfonates, sulphonated polycarboxylic acids prepared by sulphonation of the pyrolyzed product of alkaline earth metal citrates, e.g., as described in British patent specification No. 1,082,179; alkyl ester sulfonates such as C14-16 methyl ester sulfonates; acyl glycerol sulfonates, alkyl phosphates, isethionates such as the acyl isethionates, N-acyl taurates, alkyl succinamates, acyl sarcosinates, sulfates of alkylpolysaccharides such as the sulfates of alkylpolyglucoside (the nonionic nonsulfated compounds being described below), alkyl polyethoxy carboxylates such as those of the formula RO(CH2CH2O) kCH2COO-M+ wherein R is a C8-C22 alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Vinylpyrrolidone Homopolymer or Copolymer

The compositions of the present invention may optionally comprise a vinylpyrrolidone homopolymer or copolymer, or a mixture thereof. Typically, the compositions of the present invention may comprise from 0.01% to 5% by weight of the total composition of a vinylpyrrolidone homopolymer or copolymer, or a mixture thereof, more preferably from 0.05% to 3% and most preferably from 0.05% to 1%.

Suitable vinylpyrrolidone homopolymers for use herein are homopolymers of N-vinylpyrrolidone having the following repeating monomer:

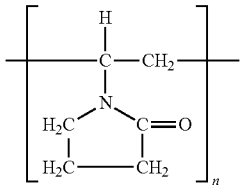

wherein n (degree of polymerisation) is an integer of from 10 to 1,000,000, preferably from 20 to 100,000, and more preferably from 20 to 10,000.

Accordingly, suitable vinylpyrrolidone homopolymers ("PVP") for use herein have an average molecular weight of from 1,000 to 100,000,000, preferably from 2,000 to 10,000,000, more preferably from 5,000 to 1,000,000, and most preferably from 50,000 to 500,000.

Suitable vinylpyrrolidone homopolymers are commercially available from ISP Corporation, New York, N.Y. and Montreal, Canada under the product names PVP K-15® (viscosity molecular weight of 10,000), PVP K-30® (average molecular weight of 40,000), PVP K-60® (average molecular weight of 160,000), and PVP K-90® (average molecular weight of 360,000). Other suitable vinylpyrrolidone homopolymers which are commercially available from BASF Cooperation include Sokalan HP 165®, Sokalan HP 12®, Luviskol K30®, Luviskol K60®, Luviskol K80®, Luviskol K90®; vinylpyrrolidone homopolymers known to persons skilled in the detergent field (see for example EP-A-262,897 and EP-A-256,696).

Suitable copolymers of vinylpyrrolidone for use herein include copolymers of N-vinylpyrrolidone and alkylenically unsaturated monomers or mixtures thereof.

The alkylenically unsaturated monomers of the copolymers herein include unsaturated dicarboxylic acids such as maleic acid, chloromaleic acid, fumaric acid, itaconic acid, citraconic acid, phenylmaleic acid, aconitic acid, acrylic acid, N-vinylimidazole and vinyl acetate. Any of the anhydrides of the unsaturated acids may be employed, for example acrylate, methacrylate. Aromatic monomers like styrene, sulphonated styrene, alpha-methyl styrene, vinyl toluene, t-butyl styrene and similar well known monomers may be used.

For example particularly suitable N-vinylimidazole N-vinylpyrrolidone polymers for use herein have an average molecular weight range from 5,000 to 1,000,000, preferably from 5,000 to 500,000, and more preferably from 10,000 to 200,000. The average molecular weight range was determined by light scattering as described in Barth H. G. and Mays J. W. Chemical Analysis Vol 113, "Modern Methods of Polymer Characterization".

Such copolymers of N-vinylpyrrolidone and alkylenically unsaturated monomers like PVP/vinyl acetate copolymers are commercially available under the trade name Luviskol® series from BASF.

According to a very preferred execution of the present invention, vinylpyrrolidone homopolymers are advantageously selected.

Polysaccharide Polymer

The compositions of the present invention may optionally comprise a polysaccharide polymer or a mixture thereof. Typically, the compositions of the present invention may comprise from 0.01% to 5% by weight of the total composition of a polysaccharide polymer or a mixture thereof, more preferably from 0.05% to 3% and most preferably from 0.05% to 1%.

Suitable polysaccharide polymers for use herein include substituted cellulose materials like carboxymethylcellulose, ethyl cellulose, hydroxyethyl cellulose, hydroxypropyl cellulose, hydroxymethyl cellulose, succinoglycan and naturally occurring polysaccharide polymers like Xanthan gum, gellan gum, guar gum, locust bean gum, tragacanth gum or derivatives thereof, or mixtures thereof.

In a preferred embodiment according to the present invention the compositions of the present invention comprise a polysaccharide polymer selected from the group consisting of: carboxymethylcellulose, ethyl cellulose, hydroxyethyl cellulose, hydroxypropyl cellulose, hydroxymethyl cellulose, succinoglycan gum, Xanthan gum, gellan gum, guar gum, locust bean gum, tragacanth gum, derivatives of the aforementioned, and mixtures thereof. Preferably, the compositions herein comprise a polysaccharide polymer selected from the group consisting of: succinoglycan gum, Xanthan gum, gellan gum, guar gum, locust bean gum, tragacanth gum, derivatives of the aforementioned, and mixtures thereof. More preferably, the compositions herein comprise a polysaccharide polymer selected from the group consisting of: Xanthan gum, gellan gum, guar gum, derivatives of the aforementioned, and mixtures thereof. Most preferably, the compositions herein comprise Xanthan gum, derivatives thereof, or mixtures thereof.

Particularly polysaccharide polymers for use herein are Xanthan gum and derivatives thereof. Xanthan gum and derivatives thereof may be commercially available for instance from CP Kelco under the trade name Keltrol RD®, Kelzan S® or Kelzan T®. Other suitable Xanthan gums are commercially available by Rhodia under the trade name Rhodopol T® and Rhodigel X747®. Succinoglycan gum for use herein is commercially available by Rhodia under the trade name Rheozan®.

It has surprisingly been found that the polysaccharide polymers or mixtures thereof herein act as surface modifying polymers (preferably combined with a vinylpyrrolidone homopolymer or copolymer, as described herein) and/or as thickening agents. Indeed, the polysaccharide polymers or mixtures thereof herein can be used to thicken the compositions according to the present invention. It has been surprisingly found that the use of polysaccharide polymers or mixtures thereof herein, and preferably Xanthan gum, provides excellent thickening performance to the compositions herein. Moreover, it has been found that the use of polysaccharide polymers or mixtures thereof herein, and preferably Xanthan gum, provides excellent thickening whilst not or only marginally reducing the limescale removal performance. Indeed, thickened compositions usually tend to show a drop in soil/stain removal performance (which in turn requires an increased level of actives to compensate for the performance drop) due to the thickening. It has been found that this is due to the fact that the actives providing the soil/stain removal performance are less free to migrate to the soil/stain. However, it has been surprisingly found that when polysaccharide polymers or mixtures thereof herein, and preferably Xanthan gum, are used as thickeners for the compositions herein, the drop in soil/stain removal performance is substantially reduced or even prevented.

Furthermore, without intended to be bound by theory, it has been shown that vinylpyrrolidone homopolymers or copolymers, preferably the vinylpyrrolidone homopolymer, and polysaccharide polymers, preferably Xanthan gum or derivatives thereof, described herein, when added into an aqueous acidic composition deliver improved shine to the treated surface as well as improved next-time cleaning benefit on said surface, while delivering good first-time hard-surface cleaning performance and good limescale removal performance. Furthermore, the formation of watermarks and/or limescale deposits upon drying is reduced or even eliminated.

Moreover, the vinylpyrrolidone homopolymers or copolymers and polysaccharide polymers further provide long lasting protection against formation of watermarks and/or deposition of limescale deposits, hence, long lasting shiny surfaces.

An additional advantage related to the use of the vinylpyrrolidone homopolymers or copolymers and polysaccharide polymers, in the acidic compositions herein, is that as they adhere on hard surface making them more hydrophilic, the surfaces themselves become smoother (this can be perceived by touching said surfaces) and this contributes to convey perception of surface perfectly descaled.

Advantageously, these benefits are obtained at low levels of vinylpyrrolidone homopolymers or copolymers and polysaccharide polymers, preferably Xanthan gum or derivatives thereof, described herein, thus it is yet another advantage of the present invention to provide the desired benefits at low cost.

Other Surface-Modifying Polymer

The compositions herein may further comprise a surface-modifying polymer other than the vinylpyrrolidone homo- or copolymers and polysaccharide polymers described herein above.

The composition herein may comprise up to 5%, more preferably of from 0.0001% to 3%, even more preferably of from 0.001% to 2%, and most preferably of from 0.01% to 1%, by weight of the total composition of said other surface-modifying polymers.

Other surface-modifying polymers are preferred optional ingredients herein as they deposit onto the surfaces cleaned with a composition according to the present invention. Thereby, soil adherence, soap scum, limescale and/or mineral encrustation build-up, is prevented.

Suitable other surface-modifying polymers may be selected from the group consisting of: zwitterionic surface modification copolymers consisting of carboxylate- and permanent cationic-moieties; zwitterionic surface modifying polysulphobetaine copolymers; zwitterionic surface modifying polybetaine copolymers; silicone glycol polymers; and mixtures thereof.

Zwitterionic surface modification copolymers consisting of carboxylate- and permanent cationic-moieties, zwitterionic surface modifying polysulphobetaine copolymers and zwitterionic surface modifying polybetaine copolymers are described in WO 2004/083354, EP-A-1196523 and EP-A-1196527. Suitable zwitterionic surface modification copolymers consisting of carboxylate- and permanent cationic-moieties, zwitterionic surface modifying polysulphobetaine copolymers and zwitterionic surface modifying polybetaine copolymers are commercially available from Rhodia in the Mirapol SURF S-polymer series.

Alternative surface modification copolymers are described in the Applicant's co-pending European Patent Applications 07 113 156.9, these copolymers are sulphobetaine/vinyl-pyrrolidone and its derivatives copolymers. A particularly suitable sulphobetaine/vinyl-pyrrolidone and its derivatives copolymer is a copolymer of 90% moles of vinyl pyrrolidone and 10% moles of SPE (sulphopropyl dimethyl ammonium ethyl methacrylate) such as exemplified in Example 1.1 of the Applicant's co-pending European Patent Applications 07 113 156.9.

Suitable silicone glycols are described in the Applicant's co-pending European Patent Applications 03 447 099.7 and 03 447 098.9, in the section titled "Silicone glycol".

Silicone glycol polymers are commercially available from General electric, Dow Corning, and Witco (see European Patent Applications 03 447 099.7 and 03 447 098.9 for an extensive list of trade names of silicone glycol polymers).

In a highly preferred embodiment according to the present invention, the silicone glycol polymer herein is a Silicones-Polyethers copolymer, commercially available under the trade name SF 1288® from Momentive Performance Materials.

Radical Scavenger

The compositions of the present invention may further comprise a radical scavenger or a mixture thereof.

Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers, when used, may be typically present herein in amounts up to 10% by weight of the total composition and preferably from 0.001% to 0.5% by weight. The presence of radical scavengers may contribute to the chemical stability of the compositions of the present invention.

Perfume

Suitable perfume compounds and compositions for use herein are for example those described in EP-A-0 957 156 under the paragraph entitled "Perfume", on page 13. The compositions herein may comprise a perfume ingredient, or mixtures thereof, in amounts up to 5.0% by weight of the total composition, preferably in amounts of 0.1% to 1.5%.

Solvent

The compositions of the present invention may further comprise a solvent or a mixture thereof, as an optional ingredient. Solvents to be used herein include all those known to those skilled in the art of hard-surfaces cleaner compositions. In a highly preferred embodiment, the compositions herein comprise an alkoxylated glycol ether (such as n-Butoxy Propoxy Propanol (n-BPP)) or a mixture thereof.

Typically, the compositions of the present invention may comprise from 0.1% to 5% by weight of the total composition of a solvent or mixtures thereof, preferably from 0.5% to 5% by weight of the total composition and more preferably from 1% to 3% by weight of the total composition.

Additional Surfactant

The compositions of the present invention may comprise an additional surfactant, or mixtures thereof, on top of the nonionic surfactant and/or anionic surfactant already described herein. Additional surfactants may be desired herein as they further contribute to the cleaning performance and/or shine benefit of the compositions of the present invention. Surfactants to be used herein include cationic surfactants, amphoteric surfactants, zwitterionic surfactants, and mixtures thereof.

Accordingly, the compositions according to the present invention may comprise up to 15% by weight of the total composition of another surfactant or a mixture thereof, on top of the nonionic surfactant already described herein, more preferably from 0.5% to 5%, even more preferably from 0.5% to 3%, and most preferably from 0.5% to 2%. Different surfactants may be used in the present invention including anionic, cationic, zwitterionic or amphoteric surfactants. It is also possible to use mixtures of such surfactants without departing from the spirit of the present invention.

Preferred surfactants for use herein are zwitterionic surfactants since they provide excellent grease soap scum cleaning ability to the compositions of the present invention.

Suitable zwitterionic surfactants for use herein contain both basic and acidic groups which form an inner salt giving both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylates and sulfonates, although other groups like sulfates, phosphonates, and the like can be used.

Some common examples of zwitterionic surfactants (i.e. betaine/sulphobetaine) are described in U.S. Pat. Nos. 2,082,275, 2,702,279 and 2,255,082.

For example Coconut dimethyl betaine is commercially available from Seppic under the trade name of Amonyl 265®. Lauryl betaine is commercially available from Albright & Wilson under the trade name Empigen BB/L®. A further example of betaine is Lauryl-immino-dipropionate commercially available from Rhodia under the trade name Mirataine H2C-HA®.

Particularly preferred zwitterionic surfactants for use in the compositions of the present invention are the sulfobetaine surfactants as they deliver optimum soap scum cleaning benefits.

Examples of particularly suitable sulfobetaine surfactants include tallow bis(hydroxyethyl) sulphobetaine, cocoamido propyl hydroxy sulphobetaines which are commercially available from Rhodia and Witco, under the trade name of Mirataine CBS® and Rewoteric AM CAS 15® respectively.

Amphoteric and ampholytic detergents which can be either cationic or anionic depending upon the pH of the system are represented by detergents such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378. Additional synthetic detergents and listings of their commercial sources can be found in McCutcheon's Detergents and Emulsifiers, North American Ed. 1980.

Suitable amphoteric surfactants include the amine oxides. Examples of amine oxides for use herein are for instance coconut dimethyl amine oxides, C12-C16 dimethyl amine oxides. Said amine oxides may be commercially available from Clariant, Stepan, and AKZO (under the trade name Aromox®). Other suitable amphoteric surfactants for the purpose of the invention are the phosphine or sulfoxide surfactants.

Cationic surfactants suitable for use in compositions of the present invention are those having a long-chain hydrocarbyl group. Examples of such cationic surfactants include the quaternary ammonium surfactants such as alkyldimethylammonium halogenides. Other cationic surfactants useful herein are also described in U.S. Pat. No. 4,228,044, Cambre, issued Oct. 14, 1980.

Dye

The liquid compositions according to the present invention may be coloured. Accordingly, they may comprise a dye or a mixture thereof. Suitable dyes for use herein are acid-stable dyes. By "acid-stable", it is meant herein a compound which is chemically and physically stable in the acidic environment of the compositions herein.

The Process of Cleaning a Hard-Surface or an Object

The present invention further encompasses a process of cleaning a hard surface or an object, preferably removing limescale from said hard-surface or said object.

The process according to the present invention comprises the steps of: applying a liquid acidic hard surface cleaning composition comprising formic acid, citric acid and an alkaline material, and having a pH of above 2.0; and mixtures thereof, onto said hard-surface or said object; leaving said composition on said hard-surface or said object to act; optionally wiping said hard-surface or object and/or providing mechanical agitation, and then rinsing said hard-surface or said object.

By "hard-surface", it is meant herein any kind of surfaces typically found in and around houses like bathrooms, kitchens, basements and garages, e.g., floors, walls, tiles, windows, sinks, showers, shower plastified curtains, wash basins, WCs, dishes, fixtures and fittings and the like made of different materials like ceramic, enamel, painted and un-painted concrete, plaster, bricks, vinyl, no-wax vinyl, linoleum, melamine, Formica®, glass, any plastics, metals, chromed surface and the like. The term surfaces as used herein also include household appliances including, but not limited to, washing machines, automatic dryers, refrigerators, freezers, ovens, microwave ovens, dishwashers and so on. Preferred hard surfaces cleaned with the liquid aqueous acidic hard surface cleaning composition herein are those located in a bathroom, in a toilet or in a kitchen, basements, garages as well as outdoor such as garden furniture, gardening equipments, driveways etc.

The objects herein are objects that are subjected to limescale formation thereon. Such objects may be water-taps or parts thereof, water-valves, metal objects, objects made of stainless-steel, cutlery and the like.

The preferred process of cleaning a hard-surface or an object (preferably removing limescale from said hard-surface or said object) comprises the step of applying a composition according to the present invention onto said hard-surface or object, leaving said composition on said hard-surface or object to act, preferably for an effective amount of time, more preferably for a period comprised between 1 and 10 minutes, most preferably for a period comprised between 2 and 4 minutes; optionally wiping said hard-surface or object with an appropriate instrument, e.g. a sponge; and then preferably rinsing said surface with water.

Even though said hard-surface or object may optionally be wiped and/or agitated during the process herein, it has been surprisingly found that the process of the present invention allows good limescale removal performance without any additional mechanical wiping and/or agitation action. The lack of need for additional wiping and/or mechanical; agitation provides an added convenience for the user of the compositions herein.

In another execution of the present invention is provided a process of cleaning an object, preferably removing limescale from an object, comprising the step of immersing said object in a bath comprising a composition according to the present invention, leaving said object in said bath for the composition to act, preferably for an effective amount of time, more preferably for a period comprised between 1 and 10 minutes, most preferably for a period comprised between 2 and 4 minutes; and then preferably rinsing said object with water.

The compositions of the present invention may be contacted to the surface or the object to be treated in its neat form or in its diluted form. Preferably, the composition is applied in its neat form.

By "diluted form", it is meant herein that said composition is diluted by the user, typically with water. The composition is diluted prior use to a typical dilution level of 10 to 400 times its weight of water, preferably from 10 to 200 and more preferably from 10 to 100. Usual recommended dilution level is a 1.2% dilution of the composition in water.

The compositions according to the present invention are particularly suitable for treating hard-surfaces located in and around the house, such as in bathrooms, toilets, garages, on driveways, basements, gardens, kitchens, etc., and preferably in bathrooms. It is however known that such surfaces (especially bathroom surfaces) may be soiled by the so-called "limescale-containing soils". By "limescale-containing soils" it is meant herein any soil which contains not only limescale mineral deposits, such as calcium and/or magnesium carbonate, but also soap scum (e.g., calcium stearate) and other grease (e.g. body grease). By "limescale deposits" it is mean herein any pure limescale soil, i.e., any soil or stains composed essentially of mineral deposits, such as calcium and/or magnesium carbonate.

The compositions herein may be packaged in any suitable container, such as bottles, preferably plastic bottles, optionally equipped with an electrical or manual trigger spray-head.

Limescale-Containing Soil Removal Performance Test Method:

Limescale-containing Soil Removal Performance Test Method: Limescale deposits found, e.g., in bathrooms are often not of pure limescale but a combination of limescale with organic soil (such as grease, soap scum, etc.). The limescale-containing soil removal performance of a given composition may be evaluated on limescale-containing soils comprising about 22% of total stain of organic deposit. In this test, enamel tiles are covered with a mixture of hard water salts and organic soil in a 22/78 ratio. An organic soil mixture of 25 g of isopropanol, 1.50 g of Albumin (an intravascular protein—commercially available as chicken egg albumin from Sigma Aldrich, A-5253), 1.25 g of artificial body soil (commercially available as ABS from Empirical Manufacturing company, OH, U.S.A.), 1.0 g of particulate soil (commercially available as HSW from Empirical Manufacturing company, OH, U.S.A.) and 1.25 g of calcium stearate is prepared. 9.42 g of this organic soil mixture is added to 4488 g of hard mineral water such as Ferrarrelle® mineral water (1.245 g/L dry weight). The solution is stirred until homogeneous and all solution is sprayed equally on 8 enamel tiles of 7*25 cm on a hotplate at 140° C. using a spray gun; this allows full water evaporation and deposition of the organic/inorganic soil (during this evaporation/deposition about 0.4 g of soil is deposited on each tile). Tiles are then baked for 1 h at 140° C. in an oven and aged at room temperature over night.

The test compositions are applied to a wet sponge, and used to clean the tiles with a Sheen scrub tester. The number of strokes required to clean to 100% clean is recorded. A minimum of 6 replicates can be taken with each result being generated in duplicate against the reference on each tile. Results are reported as cleaning index versus a reference composition.

EXAMPLES

These following compositions were made comprising the listed ingredients in the listed proportions (weight %). The examples herein are met to exemplify the present invention but are not necessarily used to limit or otherwise define the scope of the present invention.

| | Examples: | | | | | | | | |
|---|---|---|---|---|---|---|---|---|---|
| | I | II | III | IV | V | VI | VII | VIII | IX |
| Acids | | | | | | | | | |
| Formic acid | 3.0 | 1.5 | 2.5 | 2.0 | 1.8 | 2.5 | 3.0 | 1.0 | 3.0 |
| Citric acid | 1.5 | 6.0 | 4.5 | 4.0 | 7.0 | 2.0 | 1.0 | 4.0 | 2.0 |
| Alkaline Material: | | | | | | | | | |
| NaOH - to pH: | 2.1 | 2.4 | 2.2 | | | | | 3.8 | 3.0 |
| KOH - to pH: | | | | 2.4 | 2.9 | 2.2 | 2.8 | | |
| Water | up to 100% | | | | | | | | |

-continued

| | Examples: | | | | |
|---|---|---|---|---|---|
| | XIX | XX | XXI | XXII | XXIII |
| Sodium Lauryl Sulphate | — | 3.0 | 2.0 | 1.5 | — |
| Kelzan T ® | 0.28 | 0.10 | 0.35 | 0.25 | 0.40 |
| PVP | 0.05 | — | 0.25 | 0.05 | 0.25 |
| n-BPP | — | 3.5 | 2.5 | 1.6 | 2.5 |
| BHT | 0.04 | — | — | — | — |
| Perfume | 0.25 | 0.60 | 0.40 | 0.20 | 0.35 |
| Dye | 0.005 | 0.005 | 0.01 | 0.005 | 0.01 |
| KOH - to pH: | — | 3.6 | — | — | — |
| NaOH - to pH: | 2.3 | — | 3.0 | 3.3 | 3.6 |
| pH (w/o alkaline material added) | — | — | — | — | |
| Water: | up to 100% | | | | |

| | Examples: | | | | | | | | |
|---|---|---|---|---|---|---|---|---|---|
| | X | XI | XII | XIII | XIV | XV | XVI | XVII | XVIII |
| Acids | | | | | | | | | |
| Formic acid | 2.0 | 2.7 | 2.5 | 1.8 | 1.5 | 2.0 | 2.8 | 1.8 | 4.0 |
| Acetic acid | — | — | 0.75 | — | 0.5 | — | — | — | — |
| Citric acid | 3.5 | 4.6 | 4.0 | 8.0 | 1.5 | 3.0 | 2.0 | — | — |
| Lactic acid | — | — | — | 1.0 | — | 2.0 | 1.0 | — | 1.5 |
| Sulfuric acid | — | — | — | — | — | — | — | 3.0 | 3.0 |
| Surfactants | | | | | | | | | |
| Neodol 91-8 ® | 0.5 | 2.2 | 2.2 | 2.2 | 2.5 | 0.45 | 2.5 | — | — |
| Sulphated Safol 23 ® | 2.0 | — | — | — | — | — | — | — | — |
| H-LAS | — | — | — | — | — | 0.80 | — | 0.90 | 1.30 |
| NaCS | — | — | — | — | — | 1.80 | — | 2.20 | 2.50 |
| Polymers: | | | | | | | | | |
| Kelzan T ® | 0.40 | 0.25 | 0.25 | 0.25 | 0.30 | 0.10 | 0.40 | 0.45 | 0.60 |
| PVP | 0.25 | 0.05 | — | 0.25 | 0.05 | — | 0.25 | — | — |
| SF 1288 ® | — | — | — | — | — | 0.60 | | 0.90 | 1.80 |
| Solvent: | | | | | | | | | |
| n-BPP | 1.0 | — | — | 1.5 | — | — | — | — | — |
| Misc.: | | | | | | | | | |
| BHT | 0.03 | 0.03 | 0.03 | 0.03 | 0.05 | — | 0.03 | 0.15 | 0.15 |
| Perfume | 0.05 | 0.50 | 0.20 | 0.50 | 0.30 | 0.50 | 0.25 | 0.40 | 0.35 |
| Dye | 0.01 | 0.005 | 0.005 | 0.01 | 0.01 | 0.01 | 0.01 | 0.01 | 0.005 |
| Alkaline Material: | | | | | | | | | |
| KOH - to pH: | 2.3 | — | — | — | 2.8 | — | — | — | — |
| NaOH - to pH: | — | 2.2 | 2.3 | 3.6 | — | 2.5 | 2.3 | — | — |
| pH (w/o alkaline material added) | — | — | — | — | — | — | — | 0.5 | 0.5 |
| Water: | up to 100% | | | | | | | | |

| | Examples: | | | | |
|---|---|---|---|---|---|
| | XIX | XX | XXI | XXII | XXIII |
| Acids | | | | | |
| Formic acid | 2.5 | 2.8 | 2.7 | 1.0 | 2.0 |
| Citric acid | 3.6 | 1.0 | 2.0 | 3.0 | 1.0 |
| Oxalic acid | 1.0 | — | — | — | — |
| Surfactants | | | | | |
| Neodol 91-8 ® | 2.5 | 0.5 | 2.2 | 1.5 | 2.0 |
| Sulphated Safol 23 ® | — | — | — | — | 0.8 |

Formic acid, citric acid, lactic acid, acetic acid, oxalic acid and sulphuric acid are commercially available from Aldrich.

Neodol 91-8® is a $C_9$-$C_{11}$ EO8 nonionic surfactant, commercially available from SHELL.

Sulphated Safol 23® is a branched $C_{12-13}$ sulphate surfactant based on Safol 23®, an alcohol commercially available from Sasol, which has been sulphated.

Sodium lauryl sulfate is a linear C12-14 sulfate which is commercially available from Aldrich.

n-BPP is n-butoxy propoxy propanol.

Kelzan T® is a Xanthan gum supplied by Kelco.

PVP is a vinylpyrrolidone homopolymer, commercially available from ISP Corporation.

SF 1288® is a silicone-polyether copolymer, commercially available from Momentive Performance Materials.

BHT is Butylated Hydroxy Toluene

Example compositions to XVI and XIX to XXIII exhibit good or excellent limescale removal performance, whilst not being corrosive. Example compositions XVII and XVIII are comparative example compositions. Example compositions I to XXIII can be used in cleaning bathroom surfaces, including showers, bath tubs, fixtures, toilet bowls, sinks, urinals, etc.

Comparative Data

A comparative limescale removal experiment is conducted according to the Limescale-containing Soil Removal Performance Test Method as described herein above with the below detailed compositions (Compositions i and ii, which are compositions according to the present invention and compositions a, b, c, d, e and f which are comparative example compositions). For the same compositions the corrosive labeling requirement is indicated.

| | Examples: | | | | | | | |
|---|---|---|---|---|---|---|---|---|
| | a | b | i | c | d | ii | e | f |
| Acids: | | | | | | | | |
| Formic acid | — | 2.70 | 2.70 | — | 1.80 | 1.80 | 3.00 | 4.00 |
| Sulphuric acid | — | — | — | — | — | — | 3.00 | 3.00 |
| Citric acid | 4.25 | — | 4.25 | 8.00 | — | 8.00 | — | — |
| Surfactants: | | | | | | | | |
| Neodol 91-8 ® | 2.2 | 2.2 | 2.2 | 2.2 | 2.2 | 2.2 | 2.2 | 2.2 |
| Alkaline Material: | | | | | | | | |
| NaOH - to pH: | 2.2 | 2.2 | 2.2 | 2.2 | 2.2 | 2.2 | — | — |
| pH | 2.2 | 2.2 | 2.2 | 2.2 | 2.2 | 2.2 | 0.5 | 0.5 |
| Water: | | | | up to 100% | | | | |

Compositions e) and f) have no Alkaline Material added and have a pH of below 2. For the Limescale-containing Soil Removal Performance Test Method composition i) was used as the Reference composition.

| | Examples: | | | | | | | |
|---|---|---|---|---|---|---|---|---|
| | a | b | i | c | d | ii | e | f |
| Corrosive - Labeling under EU Directive 1999/45/EC: | | | | | | | | |
| Corrosive label - Yes/No | No | No | No | No | No | No | Yes | Yes |
| Limescale-containing Soil Removal Performance - Cleaning Index: | | | | | | | | |
| | 29 | 13 | 100 | 94 | <5 | 137 | 150 | 163 |

The above results clearly show that compositions comprising the acid system according to the present invention (Compositions i, and ii) show a similar or even significantly better limescale-containing soil removal performance as compared to compositions comprising formic acid or citric acid alone that are not according to the present invention (Compositions a, b, c and d) or formic acid in combination with another acid such as sulphuric acid (Compositions e and f). At the same time, it is established that compositions comprising according to the present invention (Compositions i and ii) are not considered corrosive as compared to compositions comprising formic acid with another acid such as sulphuric acid with a pH of 2.0 or below (Compositions e and f).

It is also apparent that the combination of formic acid and citric acid with an alkaline material at a pH above 2.0 results in a synergistic effect with regard to Limescale-containing Soil Removal Performance. Indeed, the cleaning index of Composition i is higher than just the sum of its parts (i.e., combination of Compositions a and b) and the cleaning index of Composition ii is higher than just the sum of its parts (i.e., combination of Compositions c and d).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid acidic hard surface cleaning composition having a pH of from about 2.1 to about 2.4 and comprising;

from about 0.5% to about 4%, by weight of the total composition, of formic acid, from about 1% to about 10%, by weight of the total composition, of citric acid, from about 0.1% to about 1%, by weight of the total composition, of oxalic acid, and from about 0.01% to about 3%, by weight of the total composition, of an alkaline material.

2. A composition according to claim 1, wherein said composition has a pH from about 2.2 to about 2.4.

3. A composition according to claim 1, wherein said composition comprises from about 1% to about 3% by weight of the total composition of formic acid.

4. A composition according to claim 1, wherein said composition comprises from about 1.5% to about 8% by weight of the total composition of citric acid.

5. A composition according to claim 1, wherein said composition further comprises acetic acid, lactic acid or mixtures thereof.

6. A composition according to claim 1, wherein said composition further comprises a nonionic surfactant or a mixture thereof.

7. A composition according to claim 1, wherein said composition further comprises an anionic surfactant or a mixture thereof.

8. A composition according to claim 1, wherein said composition further comprises a mixture of a nonionic surfactant or a mixture thereof and an anionic surfactant or a mixture thereof.

9. A composition according to claim 1, wherein said composition further comprises one or more ingredients selected from the group of: vinylpyrrolidone homopolymer or copolymer; polysaccharide polymer; surface-modifying polymers other than vinylpyrrolidone homo- or copolymers and polysaccharide polymers; solvents; anionic surfactants; cationic surfactants; amphoteric surfactants; zwitterionic surfactants; radical scavengers; caustics; perfumes; and dyes; and mixtures thereof.

10. A composition according to claim 1, wherein said alkaline material is selected from the group consisting of sodium hydroxide, potassium hydroxide, lithium hydroxide, the alkali metal oxides such, as sodium and/or potassium oxide or mixtures thereof, monoethanolamine, triethanolamine, ammonia, ammonium carbonate and, choline base and mixtures thereof, most preferably sodium hydroxide or potassium hydroxide.

11. A process of cleaning a hard surface or an object, preferably removing limescale from said hard-surface or said object, comprising the steps of: applying a liquid acidic hard surface cleaning composition according to claim 1 onto said hard-surface or said object; leaving said composition on said hard-surface or said object to act; optionally wiping said hard-surface or object and/or providing mechanical agitation, and then rinsing said hard-surface or said object.

12. A process according to claim 11, wherein said surface or object is located in a bathroom, in a toilet or in a kitchen, preferably in a bathroom.

13. A process of cleaning object, preferably removing limescale from said object, comprising the step of immersing said object in a bath comprising a composition according to claim 1, leaving said object in said bath for said composition to act, and then rinsing said object.

14. A process according to claim 13, wherein said surface or object is located in a bathroom, in a toilet or in a kitchen, preferably in a bathroom.

15. The use according to claim 14 wherein said good limescale removal performance is achieved when said composition is applied onto said hard-surface or object, said composition is left on said hard-surface or object to act, and then said hard-surface or object is rinsed.

* * * * *